US005799622A

United States Patent [19]

Waldner

[11] Patent Number: 5,799,622

[45] Date of Patent: Sep. 1, 1998

[54] FURNACE HEAT EXCHANGER TUBE CLEANING SYSTEM

[75] Inventor: Clarence Waldner, Decker, Canada

[73] Assignee: Decker Manufacturing, Decker, Canada

[21] Appl. No.: 885,172

[22] Filed: Jun. 30, 1997

[51] Int. Cl.[6] ..... F22B 37/48; F28G 1/00; F28G 9/00

[52] U.S. Cl. ..... 122/387; 122/17; 122/44.2; 122/155.2; 122/367.1; 122/367.3; 122/379; 165/94; 165/95

[58] Field of Search ..... 122/17, 367.3, 122/367.2, 367.1, 379, 387, 155.2, 44.2; 165/95, 94; 15/104.05, 104.16

[56] References Cited

U.S. PATENT DOCUMENTS

| | | | |
|---|---|---|---|
| 4,174,750 | 11/1979 | Nichols | 165/94 |
| 4,315,541 | 2/1982 | Murata et al. | 165/94 |
| 4,468,930 | 9/1984 | Johnson | 165/95 |
| 4,718,480 | 1/1988 | Kito et al. | 165/94 |
| 4,825,940 | 5/1989 | Barroyer et al. | 122/379 |
| 5,027,749 | 7/1991 | Cifaldi | 122/17 |
| 5,228,413 | 7/1993 | Tam | 122/17 |
| 5,311,929 | 5/1994 | Verret | 165/94 |
| 5,544,625 | 8/1996 | Rivern | 122/17 |

*Primary Examiner*—Teresa J. Walberg
*Assistant Examiner*—Jiping Lu
*Attorney, Agent, or Firm*—Adrian D. Battison; Murray E. Thrift

[57] ABSTRACT

A furnace heat exchanger tube cleaning apparatus is described. The furnace comprises a combustion chamber for generating heated gases including combustion products, a water jacket containing a liquid to be heated and including heat exchanger tubes passing therethrough and a flue for discharge of the combustion products. In operation, the heated gases including combustion products flow from the combustion chamber along the heat exchanger tubes to the flue. As the heated gases pass along the heat exchanger tubes, heat from the heated gases is transferred to the liquid in the container, thereby heating the liquid. The efficiency of heat transfer is increased by helical flights arranged to depend downward into the respective heat exchanger tubes from a support structure. Specifically, the flights create turbulence in the flow of the heated gases, thereby improving heat transfer. However, over time, soot and other combustion products deposit along the heat exchanger tubes, which will decrease heat transfer efficiency. In this arrangement, the heat exchanger tubes can be cleaned by raising and lowering the support structure such that the flights scrape and clean the heat exchanger tubes.

8 Claims, 3 Drawing Sheets

FURNACE HEAT EXCHANGER TUBE CLEANING SYSTEM

The present invention relates to heat exchangers. More specifically, the present invention relates to a heat exchanger tube cleaning system.

BACKGROUND OF THE INVENTION

Boilers commonly consist of a boiler housing, a combustion chamber, a water jacket for receiving the liquid to be heated, a flue for discharge of the combustion products and a series of tubes arranged to pass through the water jacket, thereby connecting the combustion chamber and the flue. Thus, heated gases produced in the combustion chamber flow up the tubes to the flue. While the heated gases pass along the tubes, heat from the gases is transferred to the liquid in the water jacket. Furthermore, the efficiency of heat transfer may be increased by creating turbulence in the flow of the heated gases by, for example, placing flights or spirals within the tubes. However, soot and other debris from the heated gases will deposit along the inner surface of the tubes as well as on the flights and spirals. This in turn greatly decreases the efficiency of heat transfer, resulting in higher fuel costs. Eventually, the boiler must be shut down and each of the heat exchanger tubes cleaned individually, a difficult and time-consuming process due to the presence of the flights and/or spirals inserted within the tubes. Clearly, a system for quickly and easily cleaning heat exchanger tubes is needed.

SUMMARY OF THE INVENTION

It is one object of the invention, therefore, to provide a system for cleaning heat exchanger tubes.

According to a first aspect of the invention, there is provided a boiler apparatus comprising:

a boiler housing;

a combustion chamber in the boiler housing for generating heated gases including combustion products;

a flue connected to the boiler housing for discharge of the combustion products;

a container in the boiler housing for receiving a liquid material to be heated;

a plurality of tubes passing through the container and extending from the combustion chamber to the flue for receiving the heated gases and communicating heat from the heated gases to the liquid material, said tubes each having an inner surface over which the heated gases and combustion products pass and an outer surface in communication with the liquid material;

each tube having therein a helically twisted flight arranged to create turbulence in the flow of the heated gases, thereby increasing heat transfer from the heated gases inner surface of the tube;

each said helically twisted flight including an outside flight edge arranged as a sliding fit within the inner surface of the respective tube and contacting the inner surface of the tube;

a lifting frame structure attached to a plurality of the flights for simultaneously causing longitudinal sliding movement of each of the plurality of flights relative to the respective tube from an operating position to a raised position and back to the operating position to effect scraping of debris deposited on the inner surface by the heated gases from the inner surface; and a lift actuating assembly for lifting the lifting frame structure. Thus, the flights not only generate turbulence in the flow of the heated gases, they are also arranged to clean the heat exchanger tubes. Specifically, the lift actuating assembly may be used to raise and lower the flights such that the flights scrape the inner surface of the tubes, thereby removing soot and other debris from the inner surface of the tubes, thereby improving heat transfer efficiency.

The boiler apparatus may include a first lifting frame structure connected to a first plurality of the flights and a second lifting frame structure attached to a second plurality of the flights, each lifting frame structure being liftable independently of the other.

Preferably, the flights are each suspended from the lifting frame structure so as to depend into the respective tube and the flights are arranged so that each slides downwardly of the respective tube under its own weight. Thus, the flights hang freely in the tubes.

The tubes may be arranged such that upper ends thereof lie in a plurality of parallel rows.

Preferably, each flight includes a top portion exposed above the respective tube with an aperture through said top portion for loosely engaging the lifting frame structure.

Preferably, the tubes are arranged in rows and wherein the lifting frame structure includes a plurality of rods each associated with a respective one of the rows such that each rod passes loosely through the apertures of the flights of the respective row, thereby connecting the flights of the respective row to the rod while allowing relative movement of each flight relative to the next to prevent binding of the flights in the tubes. The lifting frame structure may include a beam at right angles to the rods and interconnecting the rods so as to lift the rods simultaneously.

The lift actuating assembly may comprise a lever pivotally mounted on the boiler housing having a first end connected to a flexible, depending cable for manual pulling action and a second end connected to the lifting frame structure. Thus, pulling on the cable in a downward direction moves the flights from the operating position to the raised position.

According to a second aspect of the invention, there is provided a boiler apparatus comprising:

a boiler housing;

a combustion chamber in the boiler housing for generating heated gases including combustion products;

a flue connected to the boiler housing for discharge of the combustion products;

a container in the boiler housing for receiving a liquid material to be heated;

a plurality of parallel tubes arranged in an array passing through the container and extending from the combustion chamber to the flue for receiving the heated gases and communicating heat from the heated gases to the liquid material, said tubes each having an inner surface over which the heated gases and combustion products pass and an outer surface in communication with the liquid material;

the tubes being arranged such that upper ends thereof lie in a plurality of parallel rows each tube having therein a helically twisted flight arranged to create turbulence in the flow of the heated gases, thereby increasing heat transfer from the heated gases inner surface of the tube;

each said helically twisted flight including an outside flight edge arranged as a sliding fit within the inner surface of the respective tube and contacting the inner surface of the tube and a top portion exposed above the respective tube with an aperture through said top portion;

a lifting frame structure attached to a plurality of the flights for simultaneously causing longitudinal sliding movement of each of the plurality of flights relative to the respective tube from an operating position to a raised position and back to the operating position to effect scraping of debris deposited on the inner surface by the heated gases from the inner surface;

the lifting frame structure including a plurality of rods each associated with a respective one of the rows such that each rod passes loosely through the aperture of each of the flights of the respective row, thereby connecting the flights of the respective row to the rod while allowing relative movement of each flight relative to the next to prevent binding of the flights in the tubes;

the lifting frame structure including a transverse support beam attached to each rod and extending transversely to the rods;

and a lifting lever pivotally mounted on the housing with one end including a flexible depending member for manual pulling action and a second end flexibly connected to a vertical lifting rod for lifting the transverse beam, the rods attached thereto and the flights carried by the rods.

Preferably, the boiler apparatus includes a first lifting frame structure connected to a first plurality of the flights and a second lifting frame structure attached to a second plurality of the flights, each lifting frame structure being liftable independently of the other.

The flights may be arranged so that each slides downwardly of the respective tube under its own weight.

DETAILED DESCRIPTION

Figure 1:
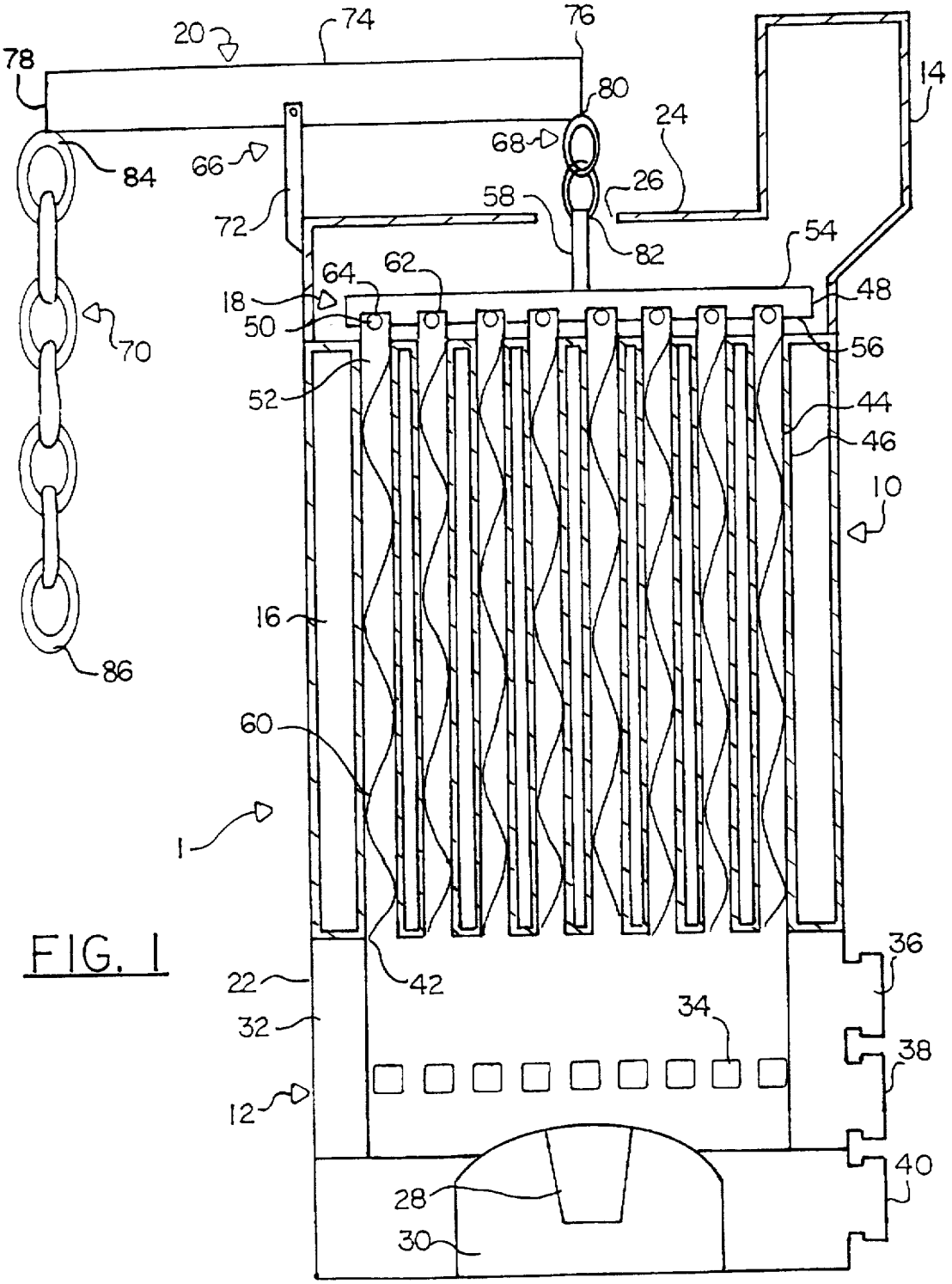
FIG. 1 is a side view in partial cross-section of the boiler apparatus.

Referring to the drawings, a boiler apparatus 1 comprises a boiler housing 10, a combustion chamber 12, a flue 14, a container 16, a lifting frame structure 18 and a lift actuating assembly 20.

The boiler apparatus 1 is arranged within the boiler housing 10 such that the flue 14 is above the container 16 and the combustion chamber 12 is below the container 16, as shown in FIG. 1. Furthermore, the lifting frame structure 18 contacts the container 16 as described below. The boiler housing 10 further comprises side walls 22 and a top 24 arranged to include an opening 26 as described below.

The combustion chamber 12 is arranged for generating heated gases including combustion products as described below. The combustion chamber 12 comprises a furnace 28, a supply duct 30, fire bricks 32 for insulation, an after-burner burner 34, an after-burner inspection door 36, a furnace inspection door 38 and an ash inspection door 40. The details of the combustion chamber 12 are not shown as these will be well-known to one skilled in the art.

The container 16 is arranged to hold a liquid to be heated therein. The container includes heat exchanger tubes 42 arranged in evenly-spaced rows extending through the container 16. The heat exchanger tubes 42 comprise an inner surface 44 over which heated gases pass as described below and an outer surface 46 which communicates with the liquid in the container 16.

The flue 14 is arranged for discharge of combustion products as described below.

Figure 2:
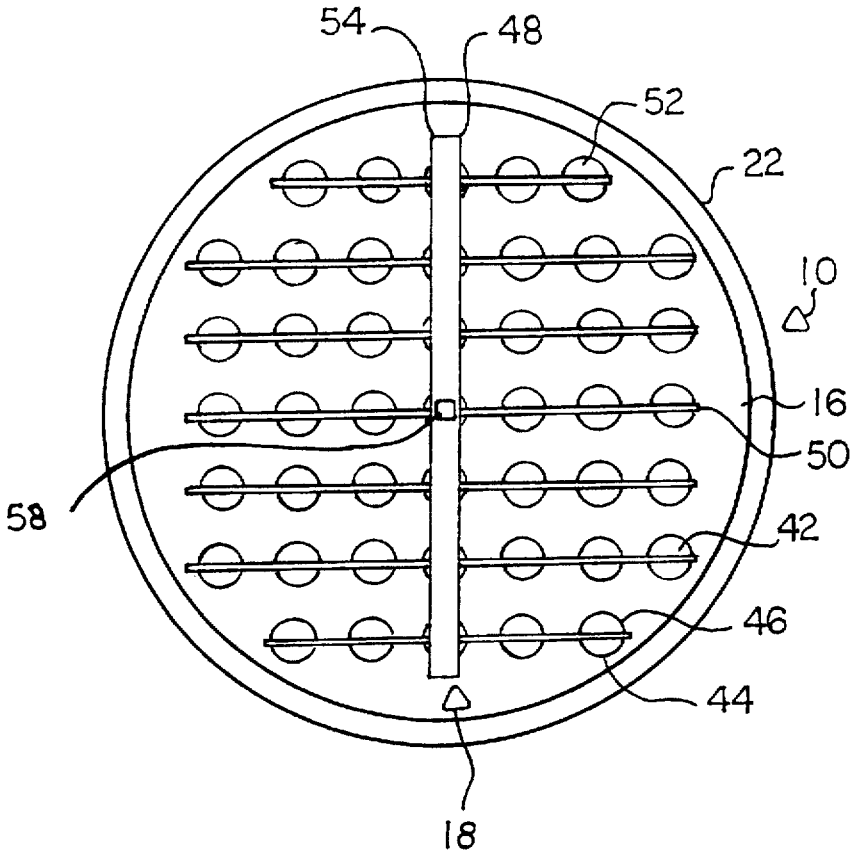
FIG. 2 is a top view of the boiler apparatus.

The lifting frame structure 18 comprises a support beam 48, rods 50 and flights 52. The support beam 48 comprises an upper surface 54 and a lower surface 56. The rods 50 are connected at right angles to the lower surface 56 of the support beam 48. Furthermore, the rods 50 are evenly spaced along the lower surface 56 of the support beam 48 at regular intervals so that the spacing between the rods 50 is approximately identical to the spacing between the heat exchanger tubes 42, as shown in FIG. 2. The upper surface 54 of the support beam 48 includes a joining member 58 that extends in an upward direction from the support beam 48 for connecting the lifting frame structure 18 to the lift actuating assembly 20, as described below. Of note is that the joining member 58 is arranged to extend upwards from the center of the lifting frame structure 18. The flights 52 are helically twisted and comprise an outside edge 60 and a top portion 62. The top portion 62 includes an aperture 64 for passing one of the rods 50 therethrough. Specifically, the flights 52 are suspended from the rods 50 by fitting the rods 50 through the apertures 64 and arranging the flights 52 at evenly-spaced intervals such that the spacing between the individual flights 52 is approximately identical to the spacing between the heat exchanger tubes 42. Of note is that the lifting frame structure 18 is arranged to contact the container 16 such that the flights 52 depend downward into the respective heat exchanger tubes 42 under their own weight as described below.

The lift actuating assembly 20 comprises a lever 66, a first cable 68 and a second cable 70. The lever 66 comprises a vertical member 72 and a lever member 74. The vertical member 72 is attached to the boiler housing 10 so as to extend vertically from the top 24 of the boiler housing 10. The lever member 74 is arranged to pivot horizontally upon the vertical member 72 and the lever member 74 comprises a first end 76 and a second end 78. The first cable 658 comprises a first end 80 and a second end 82 and the second cable 70 comprises a first end 84 and a second end 86. The first end 76 of the lever member 74 is connected to the first end 80 of the first cable 68 and the first cable 68 is arranged such that the first cable 68 passes through the opening 26 in the top 24 of the boiler housing 10 for attachment to the lifting frame structure 18 as described below. The second end 78 of the lever member 74 is connected to the first and 84 of the second cable 70 and the second cable 70 is arranged such that the second cable 70 extends downward from the lever member 74 along one side wall 22 of the boiler housing 10. As a result of this arrangement, pulling in a downward direction on the second end 86 of the second cable 70 causes the lever member 74 to pivot, thereby pulling the first cable 65 in an upward direction.

Figure 3:
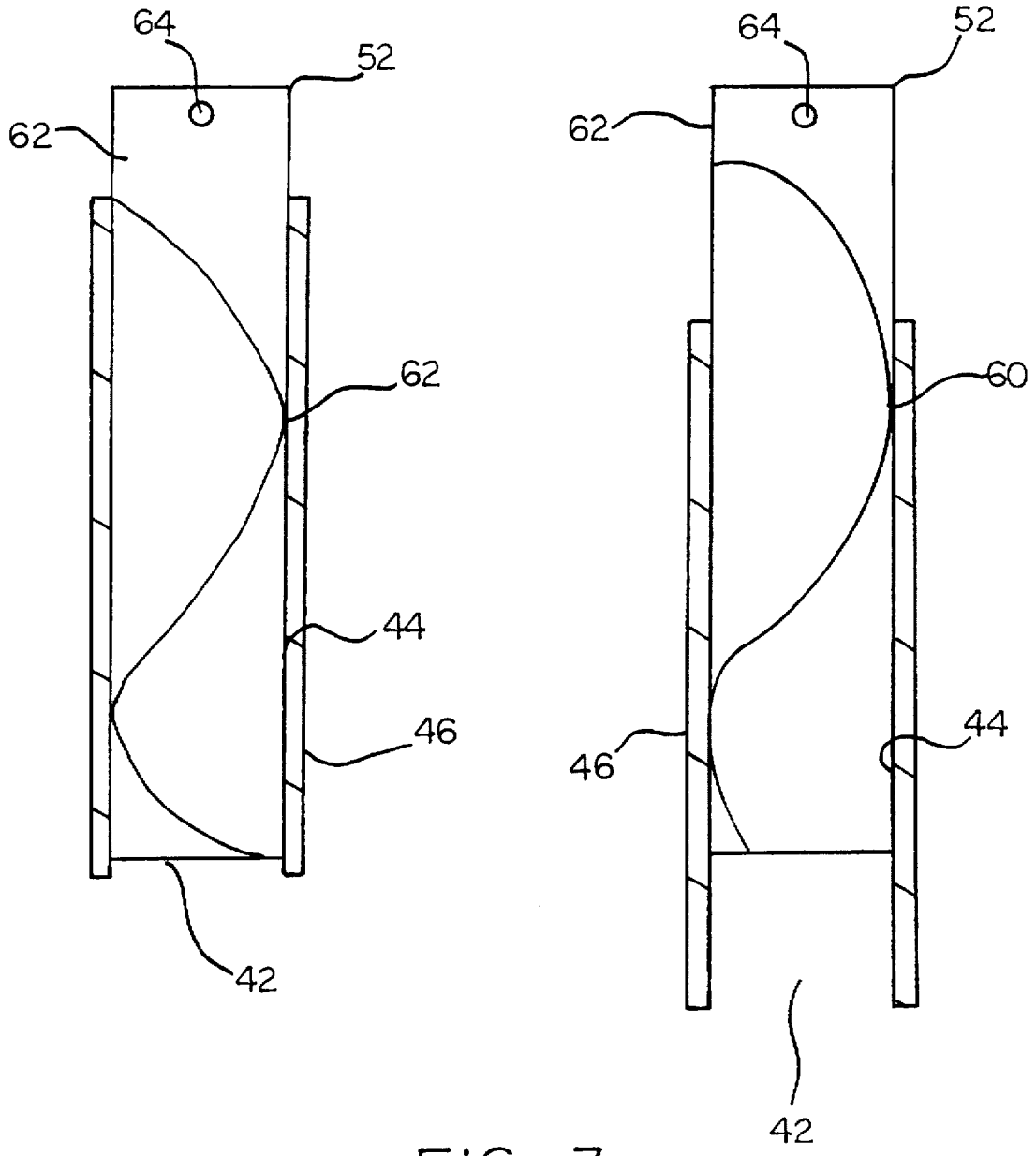
FIG. 3 is a side view of a flight in operating position and in raised position.

Assembled, the lifting frame structure 18 is fitted into the boiler housing 10 such that the rods 50 rest upon the container 16 and the flights 52 depend downward into the respective heat exchanger tubes 42. As a result of this arrangement, the outside edge 60 of each flight 52 is in a sliding fit within each heat exchanger tube 42. That is, the outside edge 60 of each flight 52 contacts the inner surface 44 of the respective heat exchanger tube 42 and each flight 52 is capable of sliding motion along the inner surface 44 of the respective heat exchanger tube 42. Next, the second end 82 of the first cable 68 is attached to the joining member 58 of the lifting frame structure 18. As noted above, pulling the second end 86 of the second cable 70 in a downward direction causes the first cable 68 to be pulled in an upward direction. As the first cable 68 is connected to the joining member 58 of the lifting frame structure 18, pulling downward on the second end 86 of the second cable 70 causes the lifting frame structure 18 to be lifted upwards. As noted above, the joining member 58 is positioned at the center of the lifting frame structure 18, meaning that the lifting frame structure 18 is balanced during raising and lowering of the lifting frame structure 18. Thus, pulling downward on the second cable 70 lifts the flights 52 from an operating position wherein the flights 52 are within the respective heat exchanger tubes 42 to a raised position wherein the flights 52 extend above the respective heat exchanger tubes 42, as shown in FIG. 3.

In operation, combustible material, such as, for example, coal, is placed in the combustion chamber 12 through the supply duct 30 and burned in the furnace 28. This produces heated gases including combustion products which flow upward from the combustion chamber 12, through the heat exchanger tubes 42 of the container 16 and out of the boiler housing 10 through the flue 14. As the heated gases pass over the inner surface 44 of the heat exchanger tubes 42, heat from the heated gases is transferred to the liquid in the container 16, thereby heating the liquid. The efficiency of heat exchange is increased by the flights 52 within the heat exchanger tubes 42, as the flights 52 create turbulence in the flow of the heated gases. Of note is that during this process, the flights 52 are in the operating position. Over time, soot and other combustion products will deposit on the inner surface 44 of the heat exchanger tubes 42 which will in turn decrease the efficiency of heat exchange between the heated gases and the liquid in the container 16. However, this can be overcome by cleaning the heat exchanger tubes 42. Specifically, the inner surfaces 44 of the heat exchanger tubes 42 are cleaned by grasping the second end 86 of the second cable 70 and pulling downward. This pulls the first cable 68 in an upward direction, which in turn lifts the lifting frame structure 18 upwards. Thus, the flights 52 move from the operating position wherein the flights 52 are within the heat exchanger tubes 42 to a raised position wherein the flights 52 extend above the heat exchanger tubes 42. During this process, the outside edge 60 of each flight 52 contacts the inner surface 44 of the respective heat exchanger tube 42, thereby scraping the inner surface 44 of the respective heat exchanger tube 42 and removing soot and other debris. The second cable 70 is then released, thereby returning the flights 52 to the operating position. Of note is that as the flights 52 return to the operating position, the outside edges 60 of the respective flights 52 contact the inner surfaces 44 of the heat exchanger tubes 42 so that further scraping of the heat exchanger tubes 42 occurs. This process may be repeated as many times as necessary to remove the soot and other debris from the inner surface 44 of the heat exchanger tubes 42.

In an alternative embodiment, the boiler apparatus 10 may be arranged to include two or more lifting frame structures 18, arranged such that each lifting frame structure 18 may be lifted independently of the other.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A boiler apparatus comprising:

a boiler housing;

a combustion chamber in the boiler housing for generating heated gases including combustion products;

a flue connected to the boiler housing for discharge of the combustion products;

a container in the boiler housing for receiving a liquid material to be heated;

a plurality of vertical tubes passing through the container and extending from the combustion chamber to the flue for receiving the heated gases and combustion products and communicating heat from the heated gases to the liquid material, said tubes each having an inner surface over which the heated gases and combustion products pass and an outer surface in communication with the liquid material;

each tube having therein a flight arranged to create turbulence in the flow of the heated gases, thereby increasing heat transfer from the heated gases inner surface of the tube, the flight consisting of a strip of rigid material which extends across the tube and which is helically twisted to define outside flight edges;

said helically twisted flight and said outside flight edges thereof being arranged such that the outside flight edges define a sliding fit with the inner surface of the respective tube and thus forming a contact with the inner surface of the tube;

a first lifting frame structure attached to a first plurality of the flights and a second lifting frame structure attached to a second plurality of the flights, the first lifting frame being arranged for simultaneously causing longitudinal vertical sliding movement of each of the first plurality of flights relative to the respective tube from an operating position to a raised position and back to the operating position and the second lifting frames being arranged for simultaneously causing longitudinal vertical sliding movement of each of the second plurality of flights relative to the respective tube from an operating position to a raised position and back to the operating position, the contact of the outside edges of the strip and the movement thereof effecting a scraping of the inner surface to remove combustion products deposited on the inner surface by the heated gases; and a first lift actuating assembly for lifting the first lifting frame structure;

and a second lift actuating assembly for lifting the second lifting frame structure independently of the first.

2. The boiler apparatus according to claim 1 wherein the flights are each suspended from the respective one of the first and second lifting frame structures so as to depend into the respective tube.

3. A boiler apparatus comprising:

a boiler housing;

a combustion chamber in the boiler housing for generating heated gases including combustion products;

a flue connected to the boiler housing for discharge of the combustion products;

a container in the boiler housing for receiving a liquid material to be heated;

a plurality of vertical tubes passing through the container and extending from the combustion chamber to the flue for receiving the heated gases and combustion products and communicating heat from the heated gases to the liquid material, said tubes each having an inner surface over which the heated gases and combustion products pass and an outer surface in communication with the liquid material;

each tube having therein a flight arranged to create turbulence in the flow of the heated gases, thereby increasing heat transfer from the heated gases inner surface of the tube, the flight consisting of a strip of rigid material which extends across the tube and which is helically twisted to define outside flight edges;

said helically twisted flight and said outside flight edges thereof being arranged such that the outside flight edges define a sliding fit with the inner surface of the respective tube and thus forming a contact with the inner surface of the tube;

a lifting frame structure attached to at least a plurality of the flights for simultaneously causing longitudinal vertical sliding movement of each of the plurality of flights relative to the respective tube from an operating position to a raised position and back to the operating position, the contact of the outside edges of the strip and the movement thereof effecting a scraping of the inner surface to remove combustion products deposited on the inner surface by the heated gases; and a lift actuating assembly for lifting the lifting frame structure;

each flight including a top portion exposed above the respective tube with an aperture through said top portion for loosely engaging the lifting frame structure;

wherein the tubes are arranged in rows and wherein the lifting frame structure includes a plurality of rods each associated with a respective one of the rows such that each rod passes loosely through the apertures of the flights of the respective row, thereby connecting the flights of the respective row to the rod while allowing relative movement of each flight relative to the next to prevent binding of the flights in the tubes.

4. The boiler apparatus according to claim 3 wherein the lifting frame structure includes a beam at right angles to the rods and interconnecting the rods so as to lift the rods simultaneously.

5. The boiler apparatus according to claim 3 wherein the lift actuating assembly comprises a lever pivotally mounted on the boiler housing having a first end connected to a flexible, depending cable for manual pulling action and a second end connected to the lifting frame structure.

6. A boiler apparatus comprising:

a boiler housing;

a combustion chamber in the boiler housing for generating heated gases including combustion products;

a flue connected to the boiler housing for discharge of the combustion products;

a container in the boiler housing for receiving a liquid material to be heated;

a plurality of vertical tubes passing through the container and extending from the combustion chamber to the flue for receiving the heated gases and combustion products and communicating heat from the heated gases to the liquid material, said tubes each having an inner surface over which the heated gases and combustion products pass and an outer surface in communication with the liquid material;

the tubes being arranged such that upper ends thereof lie in a plurality of parallel rows each tube having therein a flight arranged to create turbulence in the flow of the heated gases, thereby increasing heat transfer from the heated gases inner surface of the tube, the flight consisting of a strip of rigid material which extends across the tube and which is helically twisted to define outside flight edges;

said helically twisted flight and said outside flight edges thereof being arranged such that the outside flight edges define a sliding fit with the inner surface of the respective tube and thus forming a contact with the inner surface of the tube and said flight including a top portion of the strip exposed above the respective tube with an aperture through said top portion;

a lifting frame structure attached to at least a plurality of the flights for simultaneously causing longitudinal vertical sliding movement of each of the plurality of flights relative to the respective tube from an operating position to a raised position and back to the operating position, the contact of the outside edges of the strip and the movement thereof effecting a scraping of the inner surface to remove combustion products deposited on the inner surface by the heated gases; and the lifting frame structure including a plurality of horizontal rods each associated with and extending across a respective one of the rows at right angles to the tubes such that each rod passes loosely through the aperture of the top portion of each of the flights of the respective row, thereby connecting the flights of the respective row to the rod while allowing relative movement of each flight relative to the next to prevent binding of the flights in the tubes;

the lifting frame structure including a transverse horizontal support beam attached to each rod and extending at right angles to the rods;

and a lifting lever pivotally mounted on the housing with one end including a flexible depending member for manual pulling action and a second end flexibly connected to the transverse beam for lifting the transverse beam, the rods attached thereto and the flights carried by the rods.

7. The boiler apparatus according to claim 6 including a first lifting frame structure connected to a first plurality of the flights and a second lifting frame structure attached to a second plurality of the flights, each lifting frame structure being liftable independently of the other.

8. The boiler apparatus according to claim 6 wherein the flights are arranged so that each slides downwardly of the respective tube under its own weight.

* * * * *